US012686951B2

(12) United States Patent
Simonet et al.

(10) Patent No.: US 12,686,951 B2
(45) Date of Patent: Jul. 21, 2026

(54) FOCUSSED CHARGE ELECTROSPINNING SPINNERET

(71) Applicant: Vivolta B.V., Waalre (NL)

(72) Inventors: Marc Simonet, Eindhoven (NL); Paul Johannes Franciscus Maria Janssen, Eindhoven (NL); Ramon Hubertus Mathijs Solberg, Munstergeleen (NL)

(73) Assignee: Vivolta B.V., Waalre (NL)

( * ) Notice: Subject to any disclaimer, the term of this patent is extended or adjusted under 35 U.S.C. 154(b) by 436 days.

(21) Appl. No.: 17/606,810

(22) PCT Filed: Apr. 30, 2020

(86) PCT No.: PCT/NL2020/050273
§ 371 (c)(1),
(2) Date: Oct. 27, 2021

(87) PCT Pub. No.: WO2020/226489
PCT Pub. Date: Nov. 12, 2020

(65) Prior Publication Data

US 2022/0235491 A1 Jul. 28, 2022

(30) Foreign Application Priority Data

May 8, 2019 (NL) ..... 2023086

(51) Int. Cl.
*D01D 5/00* (2006.01)

(52) U.S. Cl.
CPC ..... *D01D 5/0069* (2013.01); *D01D 5/0092* (2013.01)

(58) Field of Classification Search
CPC ..... D01D 5/0069; D01D 5/0092
See application file for complete search history.

(56) References Cited

U.S. PATENT DOCUMENTS 4,743,922 A * 5/1988 Regnault ..... B41J 2/17 347/49
5,344,676 A * 9/1994 Kim ..... B05B 9/002 361/228
5,948,483 A * 9/1999 Kim ..... B05D 1/04 427/483

(Continued)

FOREIGN PATENT DOCUMENTS

CN 102275386 A2 12/2011
CN 105926057 B 11/2017

(Continued)

OTHER PUBLICATIONS

Reznik et al.: "Evolution of a compound droplet attached to a core-shell nozzle under the action of a strong electric field", Physics of Fluids, vol. 18, No. 6, (Jan. 1, 2006), pp. 062101-1 to 062101-13.

(Continued)

*Primary Examiner* — Emmanuel S Luk
(74) *Attorney, Agent, or Firm* — Ipsilon USA—NLO

(57) ABSTRACT

A nozzle for an electrospinning spinneret, the nozzle including a material transporting channel having a wall that has an end surface for forming a droplet, and an electrode extending through the material transporting channel at least up to the end surface of the wall.

11 Claims, 3 Drawing Sheets

(56) References Cited

Figure 1:
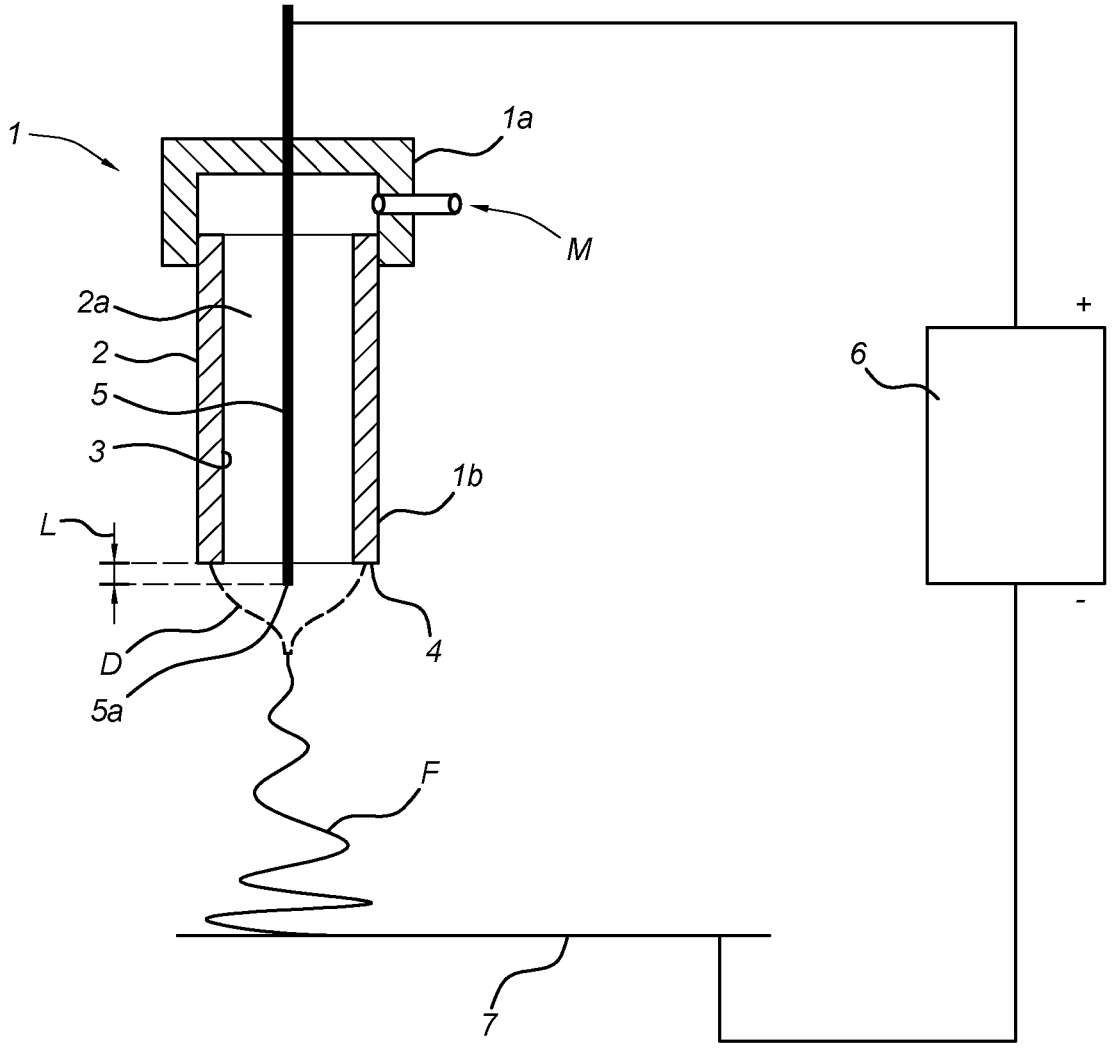

U.S. PATENT DOCUMENTS 6,656,394 B2 * 12/2003 Kelly ..... B05B 5/001 264/10
8,025,025 B2 * 9/2011 Kim ..... D01D 5/0092 118/712
8,282,873 B2 * 10/2012 Barinov ..... D01D 5/0092 264/467
8,939,388 B1 * 1/2015 Beetz ..... B05B 5/03 239/690
2005/0224998 A1 * 10/2005 Andrady ..... D01D 5/0092 264/464
2006/0110544 A1 * 5/2006 Kim ..... B05B 5/0533 427/458
2006/0226580 A1 10/2006 Xia et al.
2007/0036953 A1 * 2/2007 Nonaka ..... H05K 3/386 428/209
2010/0259358 A1 * 10/2010 Ryu ..... H01C 7/043 338/22 SD
2012/0034461 A1 2/2012 Stevens
2016/0047075 A1 * 2/2016 Foley ..... D01D 5/0084 425/174.8 E
2019/0024262 A1 * 1/2019 Johnson ..... D01D 5/0069
2019/0292685 A1 * 9/2019 Fong ..... B29C 48/142
2020/0407880 A1 * 12/2020 Madou ..... B29C 48/142
2021/0207291 A1 * 7/2021 Agrawal ..... D04H 1/728
2022/0031578 A1 * 2/2022 Sasaoka ..... A61K 8/8129

FOREIGN PATENT DOCUMENTS

CN 109594135 A 4/2019
JP 2021008696 A * 1/2021
KR 20120083102 A 7/2012
WO 2016035472 A1 3/2016

OTHER PUBLICATIONS

E. Zussman et al: "Electrospun Polyacrylonitrile/Poly(methyl methacrylate)-Derived Turbostratic Carbon Micro-Nanotubes", Advanced Materials, vol. 18, No. 3, Jan. 10, 2006, pp. 348-353.

* cited by examiner

FOCUSSED CHARGE ELECTROSPINNING SPINNERET

FIELD OF THE INVENTION

The present invention relates to a nozzle for use in an electrospinning spinneret. In a further aspect the present invention relates to an electrospinning spinneret comprising one or more nozzles.

BACKGROUND ART

International patent publication WO 2016/126201 A1 discloses a spinneret for use in electrospinning production of a filament. An inside surface of a chamber of the spinneret is provided with an electrode baffle structure to provide an electrical charge to the fluid in the chamber.

SUMMARY OF THE INVENTION

The present invention seeks to provide an improved nozzle for use in an electrospinning spinneret, wherein the nozzle provides improved high voltage efficiency, reduced corona formation and arcing as well as reduced ozone production. The nozzle further increases safety for operators.

According to the present invention, a nozzle of the type mentioned in the preamble is provided, wherein the nozzle comprises a material transporting channel having a wall, wherein the wall has a droplet forming end surface, and wherein the nozzle further comprises an electrode that extends through the material transporting channel at least up to the end surface of the wall. The end surface of the material transporting channel is a surface perpendicular to a longitudinal direction of (the material transporting channel of) the nozzle, and is arranged for electrospinning, i.e. forming and/or supporting a droplet of liquefied material (dissolved or molten), from which a fiber is electrospun during operation. It is noted that the present invention embodiments can also be advantageously used in electrospraying, forming particles instead of fibers.

The nozzle of the present invention, in particular the electrode thereof, provides a highly efficient transportation of the charge to the formed droplet, and at the same time allows to keep the charging of the nozzle, more specific in the material transporting channel, to a minimum. Focusing the charge towards the end of the nozzle/droplet results in a high charge density inside the droplet. This in turn significantly improves high voltage efficiency of the nozzle and reduces power consumption. When applied in an electrospinning spinneret comprising one or more of the present invention nozzles, a highly efficient and reliable and more reproducible electrospinning process can be obtained.

SHORT DESCRIPTION OF DRAWINGS

Figure 2:
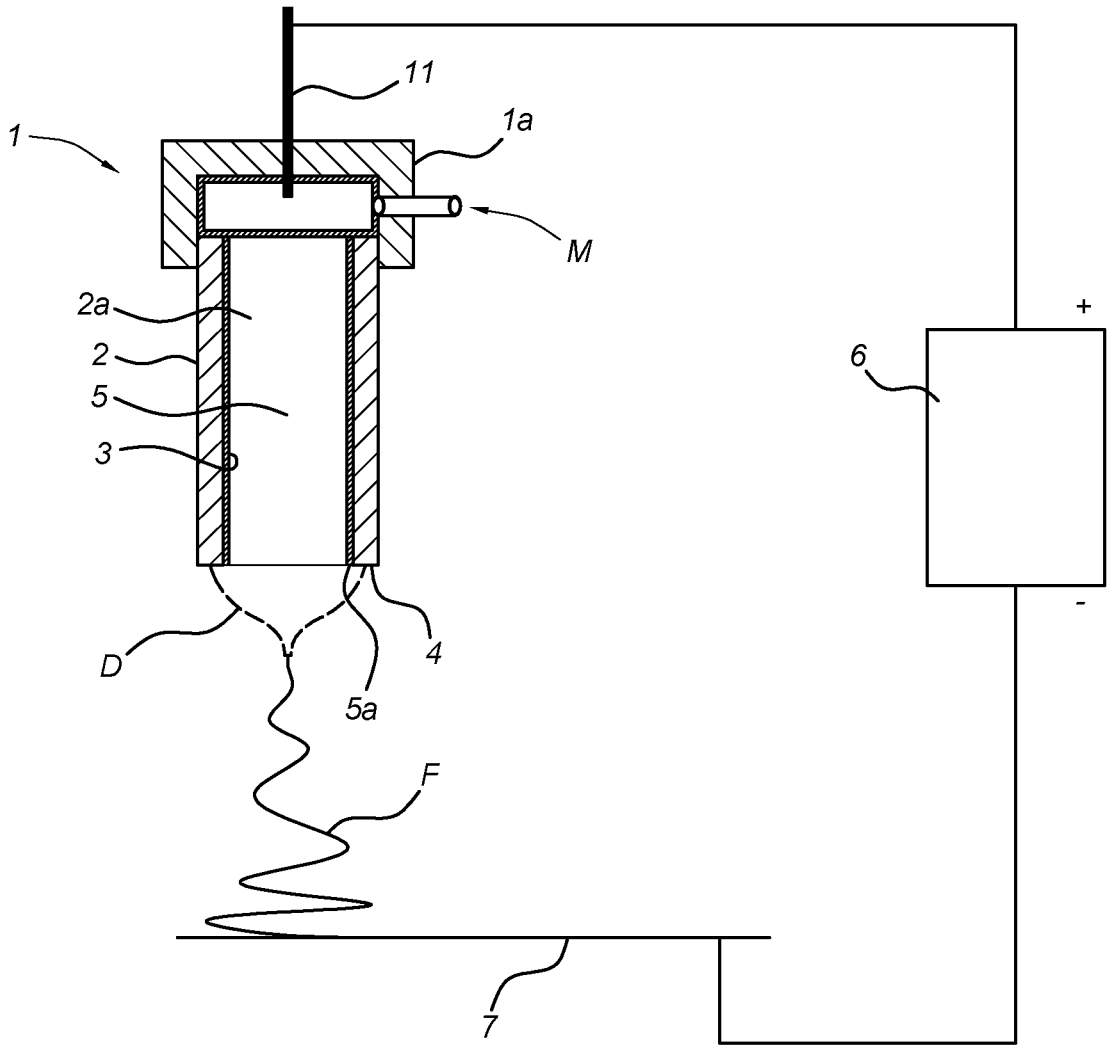
Figure 3:
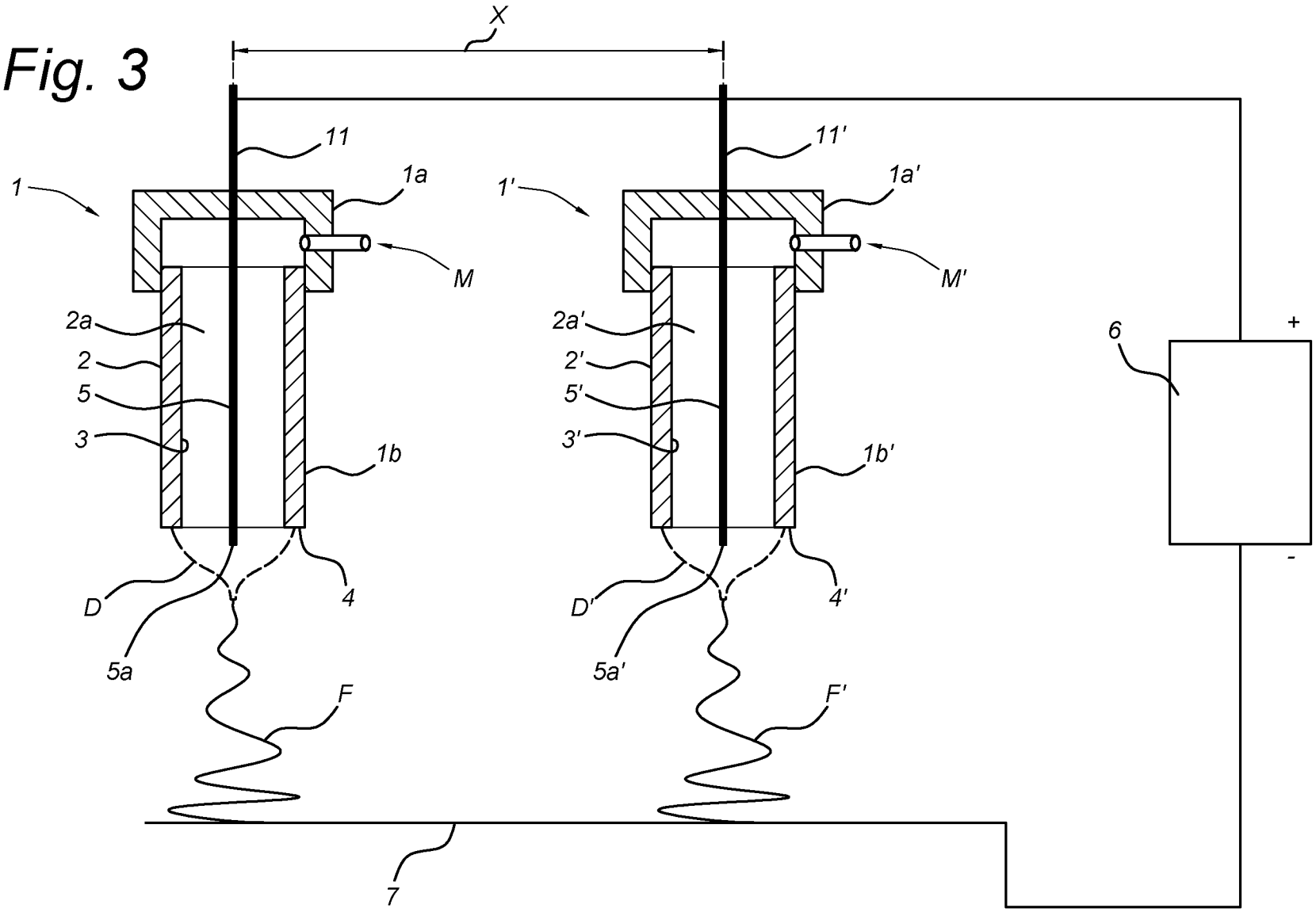

The present invention will be discussed in more detail below, with reference to the attached drawings, in which FIG. 1 shows a nozzle for an electrospinning spinneret according to a first embodiment of the present invention;

FIG. 2 shows a nozzle for an electrospinning spinneret according to a second embodiment of the present invention; and FIG. 3 shows an electrospinning spinneret comprising one or more nozzles according to an embodiment of the present invention.

DESCRIPTION OF EMBODIMENTS

Electrospinning is a method to produce continuous fibres with a diameter ranging from a few tens of nanometres to a few tens of micrometres. To produce such fibres, a suitable liquefied material may be fed through a channel of a small nozzle as part of an electrospinning "spinneret" arrangement. The liquefied material may be electrically charged by applying a high voltage (HV) between an electrode arranged on the nozzle and an opposing collector electrode spaced remote therefrom (e.g. on a target surface). The electric field being generated causes a cone-shape deformation of a droplet of the liquefied material being formed at a tip portion of the nozzle (also named Taylor cone). When surface tension of the droplet is overcome by electrical force, a jet of liquefied material moves out of the droplet producing a fiber that moves towards the opposing electrode. During flight towards the opposing electrode, the fiber is continuously stretched and elongated by different forces acting on it, thereby reducing its diameter and allowing it to solidify. The solidification may be induced by e.g. evaporation of a solvent or cooling of the material, such that a solid fiber is deposited on a target collector. This target collector may be placed just in front of the opposing electrode or the opposing electrode itself may be used as the target collector.

FIG. 1 shows a nozzle 1 for use in an electrospinning spinneret according to an embodiment of the present invention. In the embodiment shown, the nozzle 1 comprises a material transporting channel 2 having a wall 3, e.g. an inner wall of a tubular shaped material transporting channel 2, defining a passageway or lumen 2*a* through which material can be transported. As shown, the nozzle 1 comprises in inlet end 1*a* at which a liquefied material "M" may be fed into the nozzle 1 during use. In an embodiment, the liquefied material (dissolved or molten) may be a polymeric material.

The material transporting channel 2 comprises an end surface 4 for forming and/or supporting a droplet "D" of liquefied material. This end surface 4 is located at an outlet end 1*b* of the nozzle 1. The end surface 4 of the material transporting channel 2 is a surface perpendicular to a longitudinal direction of the nozzle 1, more particular of a longitudinal direction of the material transporting channel 2, and is arranged for electrospinning, i.e. forming and/or supporting a droplet of liquid material, from which a fiber is electrospun during operation, The nozzle 1 further comprises an electrode 5 that extends through the material transporting channel 2, i.e. through the passageway 2*a*, at least up to the end surface 4 of the wall 3.

Note that when the nozzle 1 is used in an electrospinning spinneret in operation, the electrode 5 may be connected to a high voltage (HV) power supply 6 and, as part of the electrospinning spinneret, a collector 7 may be arranged opposite to the electrode 5 and spaced apart therefrom. When the nozzle 1 is in use, there is a voltage difference between the electrode 5 and collector 7.

According to the invention, by allowing the electrode 5 to extend all the way to at least the end surface 4 of the wall 3, a sharply focused charge can be created in the droplet D whilst not needing to further increase the high voltage applied to the electrode 5. The focused charge in the droplet is achieved as electric charge tends to concentrate at a sharp edge surface such as the end of the electrode 5. As per the present invention, since a tip of the electrode 5 at or extending from the end surface 4 is considered closest to such an opposing collector 7 when the nozzle is used in an electrospinning spinneret, electric charge sharply focusses on the tip of the electrode 5 during an electrospinning process.

As depicted in FIG. 1, the end surface 4 of the wall 3 is to be seen as a surface extending perpendicular to a (major) longitudinal axis of the nozzle 1 at which the wall 3 terminates. The electrode 5 of the present invention embodiments then extends at least up to this end surface 4 and thus the electrode 5 may comprise an electrode tip 5*a* which extends at least up to this end surface 4, or extends from it. This may also be conceived in alternative fashion, for example, in an embodiment the wall 3 may have a different or even irregular internal shape (lumen 2*a*) which terminates at a tip of the nozzle 1, wherein the tip of the nozzle 1 substantially faces the opposing electrode 7. Note that the tip of the nozzle 1 need not be straight as depicted but may be arched or rounded to some degree. The tip of the nozzle 1 may then define the end surface 4 (a surface including an outermost nozzle point and substantially perpendicular to a longitudinal direction of the nozzle 1) to which the electrode 5 (and specifically electrode tip 5*a*) should at least extend.

The end surface 4 provides a basis at which a droplet of liquid material can be formed into a Taylor cone when the nozzle 1 is in use. Furthermore, the outermost nozzle point must be understood as being a point of the nozzle 1 opposing collector 7 when the nozzle 1 is used in an electrospinning spinneret.

To further focus electric charge density in the droplet D, in an advantageous embodiment the electrode 5, e.g. the electrode tip 5*a*, extends beyond the end surface 4 of the wall 3. So in these embodiments, the electrode 5, in particular the electrode tip 5*a*, extends over a non-zero extension length L beyond the end surface 4.

In an exemplary embodiment, the electrode 5 extends from the end surface 4 of the wall 3 over a distance of at least half of a diameter of the material transporting channel 2. In this embodiment the extension length L is at least half of the diameter of the material transporting channel 2 near to the end surface 4 to allow the electrode 5, e.g. the electrode tip 5*a*, to sufficiently extend into the droplet D when the nozzle 1 is in use and sharply focus the charge density in the droplet D. In an exemplary embodiment, the extension length L is between 0 and 5 mm, thereby allowing for a wide range of size of droplets D. In a specific embodiment, the extension length L may be about 1 micron, which may already provide a well-focused charge density in the droplet D.

As further depicted in FIG. 1, in an embodiment the electrode 5 may be arranged centrally within the material transporting channel 2, thereby enhancing the focusing of the charge density in the droplet D. In a further embodiment the electrode 5 may be a wire electrode, e.g. a wire having a diameter of 0.01 to 2 mm, thereby allowing for a wide range of nozzle sizes. In exemplary embodiments the electrode 5 is a wire electrode having a diameter of about 0.1, 0.2 or 0.4 mm.

FIG. 2 shows a nozzle 1 for use in an electrospinning spinneret according to a further embodiment of the present invention, wherein the electrode 5 is positioned on an inner surface of the wall 3. In this embodiment, the electrode 5 extends at least in part along the wall 3 of the material transporting channel 2 toward the end surface 4 for providing a focused electric charge in the droplet D, transferring the charge all the way to the tip of the nozzle in an efficient way without relying on the conductivity of the liquefied material.

In a further embodiment the electrode 5 extends circumferentially along the wall 3 toward the end surface 4 (or the wall termination point 8 or outermost nozzle point 10). In this way a tubular electrode 5 may be obtained to allow for a circumferential or ring-like focused electric charge on the end surface 4.

In an advantageous embodiment, the electrode 5 is an electrically conductive deposited layer, e.g. deposited on the wall 3, for reduced design complexity of the nozzle 1 and facilitate manufacturing thereof through, e.g., using electroplating, PVD, chemical coating etc. In an advantageous embodiment the electrically conductive deposited layer comprises gold (Au), silver (Ag), and/or copper (Cu) to provide excellent electrical conductivity for creating a strongly focused electric field at the end surface 4. In FIG. 2 it is further shown that in an embodiment the electrically conductive deposited layer may be electrically connected to an upper electrode connector 11 arranged at the inlet side 1*a* of the nozzle 1.

In an embodiment, the material transporting channel 2 may comprise a non-conductive material, so that only the electrode 5 and in particular the electrode tip 5*a* contributes to the electrical field in the droplet D. In an embodiment, the non-conductive material may be a polymer or synthetic material. In an alternative embodiment the non-conductive material may be a ceramic material, which provides for a mechanically durable material transporting channel 2. In an even further embodiment, the non-conductive material may be a glass material.

In an alternative embodiment the material transporting channel 2 may (partially) comprise or be made of an electrically conductive material. Although this possibly provides for a secondary region of (weaker) focused electric charge at the end surface 4, a much stronger primary focused electric charge is provided by the electrode 5.

As mentioned above, according to the invention the electrode 5 extends through the material transporting channel 2 at least up to the end surface 4 of the wall 3 which will be located closest to an opposing collector 7 when the nozzle 1 is used in an electrospinning spinneret. The electrode 5 allows for strongly focused electric charge in the droplet D for improving stable fibre formation and also to reduce the voltage applied to the electrode 5 as much as possible, thereby improving high voltage efficiency.

Prior art electrospinning spinneret designs often use all metal parts in nozzles in order to provide a high voltage from the nozzle toward a droplet. However, the amount of (exposed) metal of nozzles increases when the number of nozzles in an electrospinning spinneret increases, yielding a lower charge density at each nozzle of the electrospinning spinneret, and possibly resulting in mutual influencing of the electric field in the different nozzles. To compensate for such lower charge density, the electrode voltage must be increased in such prior art designs.

Other prior art electrospinning spinneret designs use conductivity of a liquid solution in order to transfer electric energy. However, (variable) conductivity of such a liquefied material solution has a direct effect on performance and power requirements of the electrospinning process.

Another problem seen with prior art multi-nozzle electrospinning spinnerets is that increasing the electrode voltage often yields an unstable electrospinning process due to higher repulsion forces of charged fibres The nozzle 1 of the present invention reduces the above mentioned interaction if multiple nozzles 1 are used in a spinneret as there is a sharply focused electric charge density at the electrode 5 rather than the nozzle 1 itself, i.e. the material transporting channel 2. This in turn reduces loss of electric charge density at the droplet D and improves high voltage efficiency and lowers power consumption.

FIG. 3 shows an electrospinning spinneret comprising one or more nozzles 1, 1', e.g. two spaced apart nozzles 1,1', according to an embodiment of the present invention.

As shown, each of the electrodes 5, 5' extends at least up to their respective end surfaces 4, 4' of the walls 3, 3'. This allows for sharply focused electric charge densities at the droplets D, D' and as such each individual nozzle 1, 1' exhibits improved high voltage efficiency and lower power consumption.

According to the present invention, an electrospinning spinneret is thus provided comprising one or more nozzles 1, 1' as described above, thereby reducing the power to operate the electrospinning spinneret as well as reducing interaction/interference between the one or more nozzles 1, 1', thereby simplifying control of the electrospinning process.

In an embodiment, an electrode distance X between two or more electrodes 5, 5' may be chosen so as to further control the influence/interaction between the electric charge of each nozzle 1, 1'

In an embodiment, the electrospinning spinneret may further comprise a fluid supply (not shown) for each of the one or more nozzles 1, 1' as well as a control unit (not shown) for individually controlling a flow rate of each fluid supply to achieve optimal fibre formation at each nozzle 1, 1'. In an embodiment, the fluid supply may provide to each of the one or more nozzles 1, 1' a liquefied material M, M', e.g. a polymeric material M, M'.

In a further embodiment, the electrospinning spinneret further comprises a high voltage power supply 6, 6' for each of the one or more nozzles 1, 1', and a control unit for individually controlling the output of each high voltage power supply 6, 6', see e.g. the embodiment shown in FIG. 3.

Utilizing a particular arrangement of a plurality of nozzles 1, 1' allows for electrospinning spinnerets that exhibit high voltage efficiency, provide reduced nozzle interference, and consume less power. For example, in an embodiment the electrospinning spinneret, the one or more nozzles 1, 1' are arranged in a circular arrangement. Such a circular arrangement can be miniaturized (i.e. made smaller) as the plurality of nozzles 1, 1' exhibit less mutual interference because of the increased focused electric charge density at each of the electrodes 5, 5'. In a specific group of embodiments, the electrospinning spinneret may comprise a circular arrangement of five nozzle at an angular separation of 72° degrees, or e.g. six nozzles at angular separation of 60° degrees.

The electrospinning spinneret of the present invention may also comprise a plurality of nozzles 1, 1' that are arranged in alternative fashion. For example, in an embodiment the plurality of nozzles 1, 1' may be arranged in an m×n array, m and n being integers. As with circular arrangements, the nozzle 1 of the present invention allows for an array of m×n nozzles 1,1' that can be arranged more densely (e.g. at an equidistant spacing) without introducing unwanted interference between the plurality of nozzles 1, 1'.

In the above, exemplary embodiments of the present invention have been described with reference to the drawings, which may also be described by the following numbered and interrelated embodiments.

Embodiment 1. A nozzle (1) for an electrospinning spinneret, wherein the nozzle (1) comprises a material transporting channel (2) having a wall (3), wherein the wall (3) has an end surface (4) for forming a droplet, wherein the nozzle (1) further comprises an electrode (5) extending through the material transporting channel (2) at least up to the end surface (4) of the wall (3).

Embodiment 2. The nozzle according to embodiment 1, wherein the electrode (5) extends beyond the end surface (4) of the wall (3).

Embodiment 3. The nozzle according to embodiment 1, wherein the electrode (5) extends from the end surface (4) of the wall over a distance (L) of at least half of a diameter of the channel (2).

Embodiment 4. The nozzle according to any one of embodiments 1-3, wherein the electrode (5) is positioned on an inner surface of the wall (3).

Embodiment 5. The nozzle according to embodiment 4, wherein the electrode (5) is an electrically conductive deposited layer.

Embodiment 6. The nozzle according to embodiment 4, wherein the electrode (5) is arranged centrally within the material transporting channel (2).

Embodiment 7. The nozzle according to embodiment 6, wherein the electrode (5) is a wire.

Embodiment 8. The nozzle according to any one of embodiments 1-7, wherein the material transporting channel (2) is of an electrically non-conductive material.

Embodiment 9. The nozzle according to embodiment 8, wherein the electrically non-conductive material is a polymer or synthetic material.

Embodiment 10. The nozzle according to embodiment 8, wherein the electrically non-conductive material is a ceramic material.

Embodiment 11. The nozzle according to any one of embodiments 1-7, wherein the material transporting channel (2) comprises electrically conductive material.

Embodiment 12. An electrospinning spinneret comprising one or more nozzles (1, 1') according to any one of embodiments 1-11.

Embodiment 13. The electrospinning spinneret according to embodiment 12, further comprising a fluid supply for each of the one or more nozzles (1, 1'), and a control unit for individually controlling the flow rate of each fluid supply.

Embodiment 14. The electrospinning spinneret according to embodiment 12 or 13, further comprising a high voltage power supply (6, 6') for each of the one or more nozzles (1, 1'), and a control unit for individually controlling the output of each high voltage power supply (6. 6).

Embodiment 15. The electrospinning spinneret according to embodiment 12, 13 or 14, wherein the one or more nozzles (1, 1') are arranged in a circular arrangement.

Embodiment 16. The electrospinning spinneret according to embodiment 12, 13 or 14, wherein the one or more nozzles (1, 1') are arranged in an m×n array, m and n being integers.

The present invention has been described above with reference to a number of exemplary embodiments as shown in the drawings. Modifications and alternative implementations of some parts or elements are possible, and are included in the scope of protection as defined in the appended claims.

The invention claimed is:

1. A nozzle for an electrospinning spinneret, wherein the nozzle comprises a material transporting channel having a wall, wherein the wall has an end surface for forming a droplet, wherein the end surface is located at an outlet of the nozzle and the wall ends at the end surface, wherein the material transporting channel, including the wall and the end surface, is of an electrically non-conductive material, wherein the nozzle further comprises an electrode extending through the material transporting channel at least up to the end surface of the wall, wherein the electrode is arranged centrally within the material transporting channel, wherein the electrode extends beyond the end surface of the wall, and the electrode is configured to form a voltage with a collector opposite to the electrode and spaced apart from the electrode, wherein the electrode extends through an interior of the material transporting channel and protrudes beyond the end surface into a Taylor cone forming region, and wherein the end surface of the wall is configured to support formation of the Taylor cone from which a fiber is electrospun.

2. The nozzle according to claim 1, wherein the electrode extends from the end surface of the wall over a distance of at least half of a diameter of the channel.

3. The nozzle according to claim 1, wherein the electrode is a wire.

4. The nozzle according to claim 1, wherein the electrically non-conductive material is a polymer or synthetic material.

5. The nozzle according to claim 1, wherein the electrically non-conductive material is a ceramic material.

6. An electrospinning spinneret comprising one or more nozzles of claim 1.

7. The electrospinning spinneret according to claim 6, further comprising a fluid supply for each nozzle of the one or more nozzles, and a control unit for individually controlling the flow rate of each fluid supply.

8. The electrospinning spinneret according to claim 6, further comprising a high voltage power supply for each nozzle of the one or more nozzles, and a control unit for individually controlling the output of each high voltage power supply.

9. The electrospinning spinneret according to claim 6, wherein the one or more nozzles comprise a plurality of nozzles that are arranged in a circular arrangement.

10. The electrospinning spinneret according to claim 6, wherein the one or more nozzles comprise a plurality of nozzles that are arranged in an m×n array, m and n being integers.

11. The electrospinning spinneret according to claim 6, wherein the one or more nozzles comprise a plurality of nozzles.

* * * * *